US009174082B1

(12) United States Patent
Marlow

(10) Patent No.: US 9,174,082 B1
(45) Date of Patent: Nov. 3, 2015

(54) ABDOMINAL EXERCISE ROLLING PAD

(71) Applicant: Gregory S. Marlow, Warminster, PA (US)

(72) Inventor: Gregory S. Marlow, Warminster, PA (US)

( * ) Notice: Subject to any disclaimer, the term of this patent is extended or adjusted under 35 U.S.C. 154(b) by 57 days.

(21) Appl. No.: 14/054,026

(22) Filed: Oct. 15, 2013

Related U.S. Application Data

(60) Provisional application No. 61/781,833, filed on Mar. 14, 2013.

(51) Int. Cl.
*A63B 23/02* (2006.01)
*A63B 21/00* (2006.01)
*A63B 21/02* (2006.01)

(52) U.S. Cl.
CPC ..... *A63B 23/0205* (2013.01); *A63B 21/00185* (2013.01); *A63B 21/02* (2013.01); *A63B 21/1496* (2013.01); *A63B 2213/00* (2013.01)

(58) Field of Classification Search
CPC ..... A61H 15/00; A61H 2015/0007; A61H 2015/0014; A61H 2015/0021; A61H 2015/0042; A61H 2015/005; A61H 2015/0057; A61H 2015/0064; A61H 2015/0015; A61H 2015/0028; A61H 2015/00035; A61H 2015/0092; A63B 22/20; A63B 21/0004; A63B 21/068; A63B 23/1236; A63B 21/015; A63B 23/0211
USPC ..... 482/107, 132; 601/119–120
See application file for complete search history.

(56) References Cited

U.S. PATENT DOCUMENTS

| | | | | |
|---|---|---|---|---|
| 5,577,995 | A * | 11/1996 | Walker et al. | 601/120 |
| 6,328,680 | B1 | 12/2001 | Shifferaw | |
| 7,837,603 | B1 | 11/2010 | Carnell, Sr. | |
| 7,935,035 | B2 | 5/2011 | Smith | |
| 8,075,464 | B2 | 12/2011 | Hayes et al. | |
| 8,105,216 | B2 | 1/2012 | Hazan et al. | |
| D654,970 | S | 2/2012 | Daves | |
| D666,255 | S | 8/2012 | Babchinetskaya et al. | |
| 2011/0245741 | A1* | 10/2011 | L'Homme et al. | 601/120 |
| 2014/0114221 | A1* | 4/2014 | Indermill et al. | 601/120 |

* cited by examiner

*Primary Examiner* — Oren Ginsberg
*Assistant Examiner* — Jennifer M Deichl
(74) *Attorney, Agent, or Firm* — Robert C. Montgomery; Montgomery Patent & Design, LP

(57) ABSTRACT

An exercise device designed to work and strengthen abdominal muscles while in a standing position comprises a center tube that forms the main axle of the device. The center tube extends completely through where it forms the left and right gripping handles. A pair of padded rollers is rotatingly supported upon the center tube and are pressed upon and then motioned downwardly and upwardly over a user's quadriceps in a reciprocating manner to exercise the abdominal muscles. A gap between the rollers is provided to allow clearance for the device as it is utilized.

14 Claims, 4 Drawing Sheets

ABDOMINAL EXERCISE ROLLING PAD

RELATED APPLICATIONS

The present invention was first described in and claims the benefit of U.S. Provisional Application No. 61/781,833, filed Mar. 14, 2013, the entire disclosures of which are incorporated herein by reference.

FIELD OF THE INVENTION

The present invention relates to an exercise device for abdominal muscles involving a pair of roller assemblies rotatingly mounted to a central tubular member and defining a gap therebetween to enable a user to operate the device in a standing position.

BACKGROUND OF THE INVENTION

Physical fitness and good health are among the areas of highest concerns among Americans today. More than ever, people frequent health clubs and perform exercise routines at home in order to lose weight, improve muscle tone, and maintain a healthy lifestyle. One (1) area that many people concentrate on is their abdominal and adjacent area. This area around one's waist is usually very difficult to reduce with standard equipments. Further, existing equipment tend to require a user to be in a horizontal position while exercising, thus putting undue strain on a user's back. Accordingly, there is a need for means by which exercise workout equipment can effectively target the abdominal area while minimizing excess strain on the user's back. The development of the rolling pad fulfills this need.

The rolling pad, as its name implies, is an exercise machine designed to work and strengthen abdominal muscles while in a standing position. The invention is approximately twenty-eight inches (28 in.) long and four inches (4 in.) in circumference. A center tube forms the main axle of the device, and extends completely through where it forms the left and right handles of the invention. Handle stops then separate the handles from an outer tube which is supported by bushings or bearings off of the interior tube. This outer tube is then covered with foam padding that is used to reduce the localized pressure upon the user's thighs. A gap between the left and right padding is provided to allow the invention to be rolled over the user's genitals. The invention is used in a standing position by first grasping the handles, and pressing it against the hips just above the level of the pubic bone. It is then rolled over the thighs toward the knees. With this exercise motion, the abdominal muscles are tightened and the abdomen is curled while standing. The use of the rolling pad, allows body builders and health enthusiasts to obtain a complete and thorough workout of their abdominal area, in a manner which is quick, easy, and effective.

SUMMARY OF THE INVENTION

The rolling pad is designed with utility and convenience in mind. The purpose of the device is to allow a user to exercise the abdominal muscles in a standing position, thus minimizing undue strain on the user's back. Because the user do not need to stretch out horizontally to use this device, this invention can be used anywhere, unlike other contraptions that require a certain amount of space. The efficiency and convenience of this invention is unmatched by any other tools currently.

The device is approximately twenty-eight inches (28 in.) in length and four inches (4 in.) in diameter. It has a central tube forming an axle, with two (2) handle portions at the ends. A first roller and a second roller are affixed on the axle in a way that allows the rollers to rotate freely, and they are located on each side of the axle, adjacent to each handle portion. The rollers provide padding to protect a user's legs during exercising. The two (2) rollers are separated by a space on the axle, so that the device can roll over the user's crotch area without hindrance.

The central tube is preferably made of a metal material such as stainless steel or aluminum. The tube forms the main axle of the device and extends outwardly, forming first handle and second handle end portions, which provide respective laterally-adjustable grips for a user's left and right hands during exercising. A center portion of the tube is encompassed around by a pair of freely rotating tubular bushings made of TEFLON®, nylon, or other material having equivalent lubricity characteristics. The bushings are sized so that they can be inserted into the rollers on each end.

The rollers are cylindrical in shape, and they are preferably made of a padding material such as urethane foam rubber or equivalent soft compliant material. The bushings separate and position the rollers by having four collars, each being a disc shaped structure. The first collar and second collar are positioned against opposing side surfaces of the first roller, and the third collar and fourth collar are positioned against opposing side surfaces of the second roller. The rollers are preferably positioned approximately six inches (6 in.) from each other using the collars to form a recessed intermediate section, thereby allowing the device to be rolled comfortably without contacting the user's groin area.

The grips are securely inserted upon each handle portion via a tight friction-fit allowing lateral adjustment along the handles based upon a user's preference. Each grip has a plastic or rubber tubular form similar to a bicycle handlebar grip. The grips are may have some molded-in finger relief features for a firm hold.

To use the device, the user simply grips the device by the handles while in a standing position. The device should rest comfortably on the front of the user's hip. The user can then, while maintaining pressure on the body through the device, slowly bend down and roll the device towards his/her knee. The device will be in contact with the user's body during the entire time. After reaching the desired bottom position, the user may retract the position upward, while also maintaining contact between the device and the body. This process may be repeated for the desired duration.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
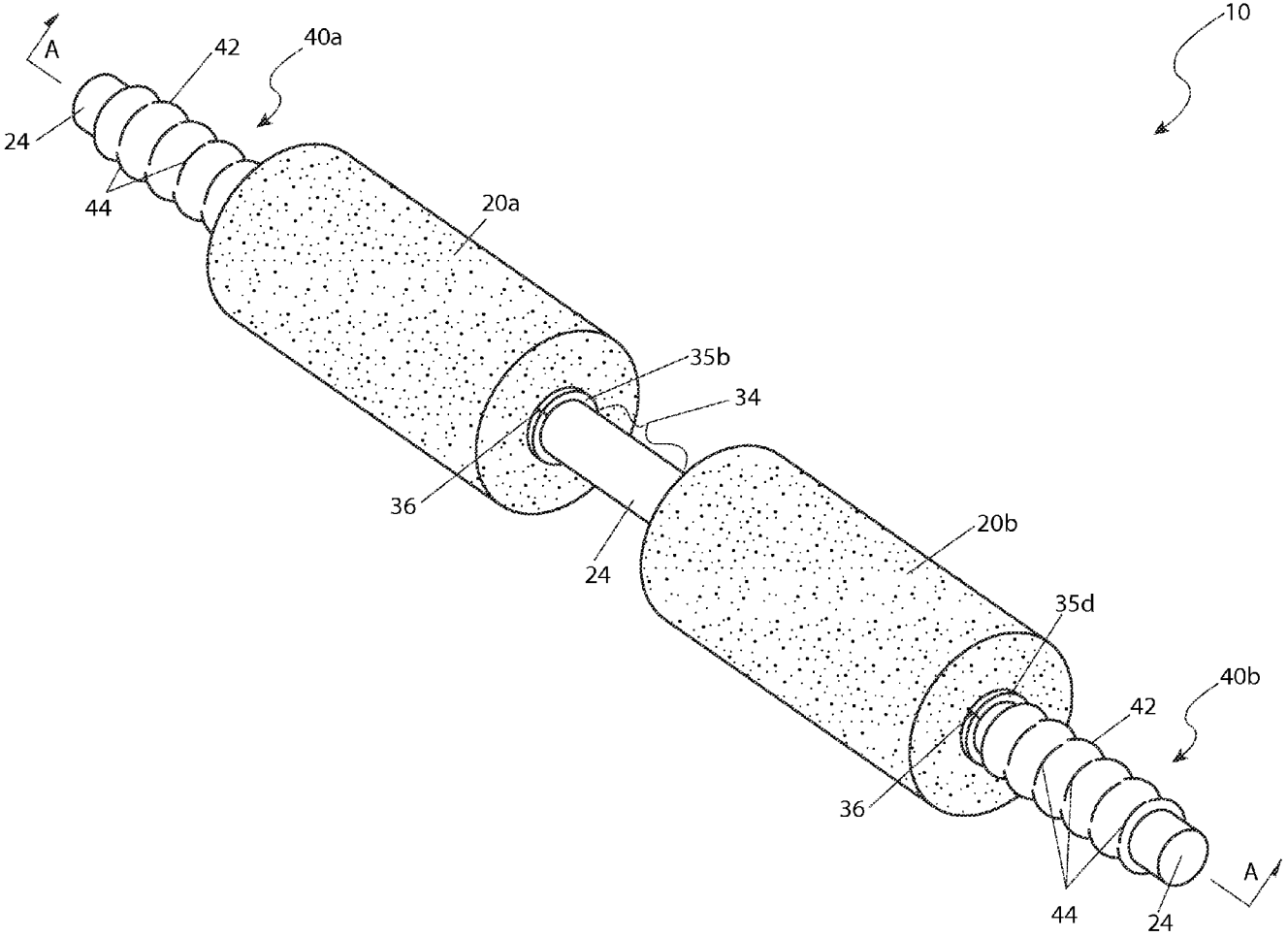
FIG. 1 is a perspective view of an abdominal exercise device 10, according to a preferred embodiment of the present invention.

10 abdominal exercise device
20*a* first roller
20*b* second roller
22 roller aperture
24 tube
30*a* first bushing
30*b* second bushing
34 intermediate section
35*a* first collar
35*b* second collar
35*c* third collar
35*d* fourth collar
36 slit
40*a* first handle
40*b* second handle
42 grip
44 finger relief
100 user
105 abdominal muscles
110 hand
115 quadriceps

DETAILED DESCRIPTION OF THE PREFERRED EMBODIMENT

Figure 2A:
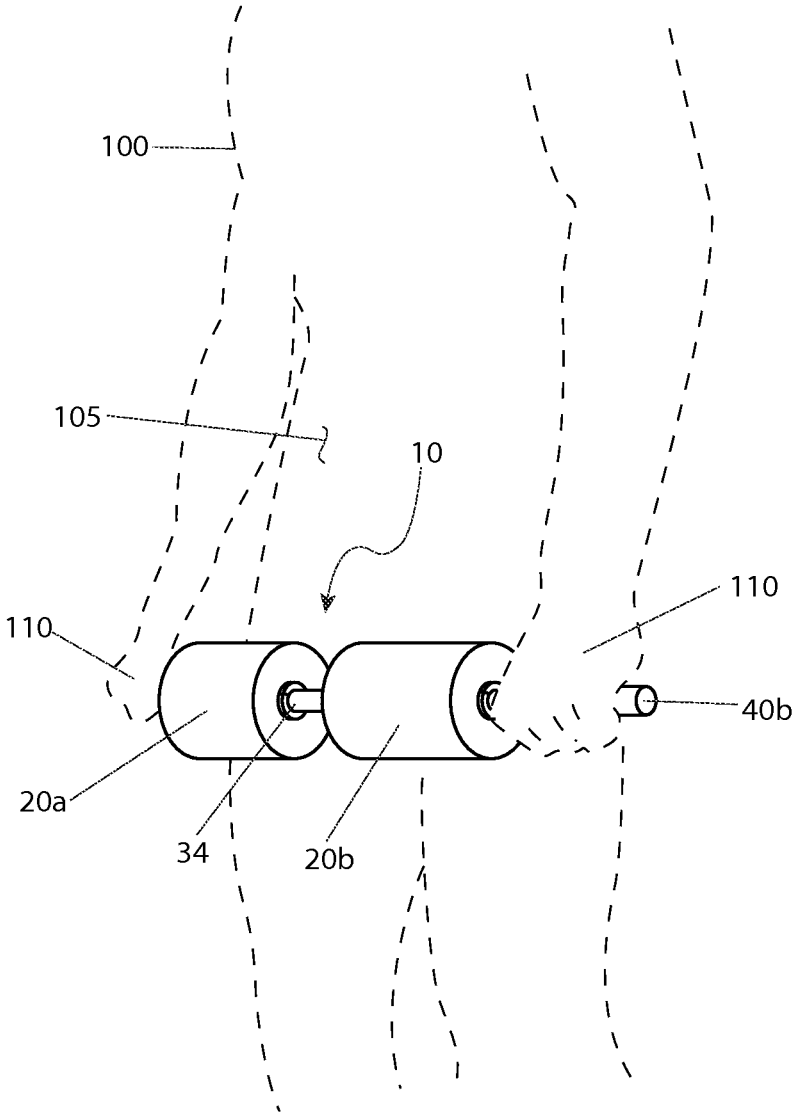
FIG. 2*a* is an environmental view of the abdominal exercise device 10 depicting an in-use erect position, according to a preferred embodiment of the present invention.
Figure 2B:
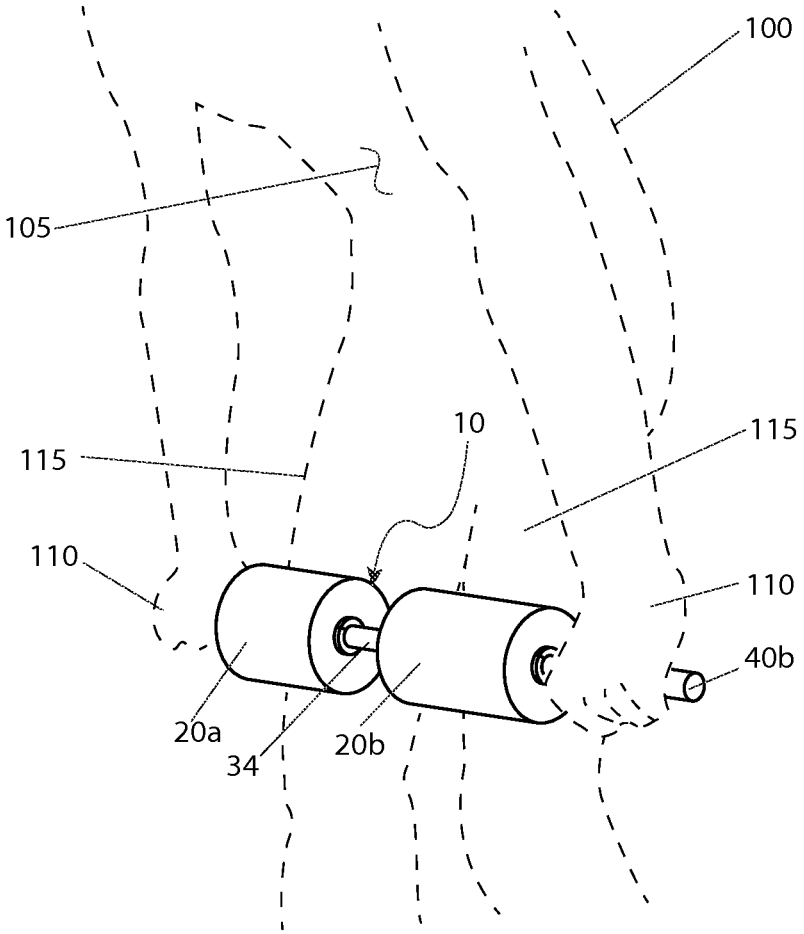
FIG. 2*b* is another environmental view of the abdominal exercise device 10 depicting an in-use forwardly extended position, according to a preferred embodiment of the present invention; and, FIG. 3 is a sectional view of the abdominal exercise device 10 taken along section line A-A (see FIG. 1), according to a preferred embodiment of the present invention.
Figure 3:
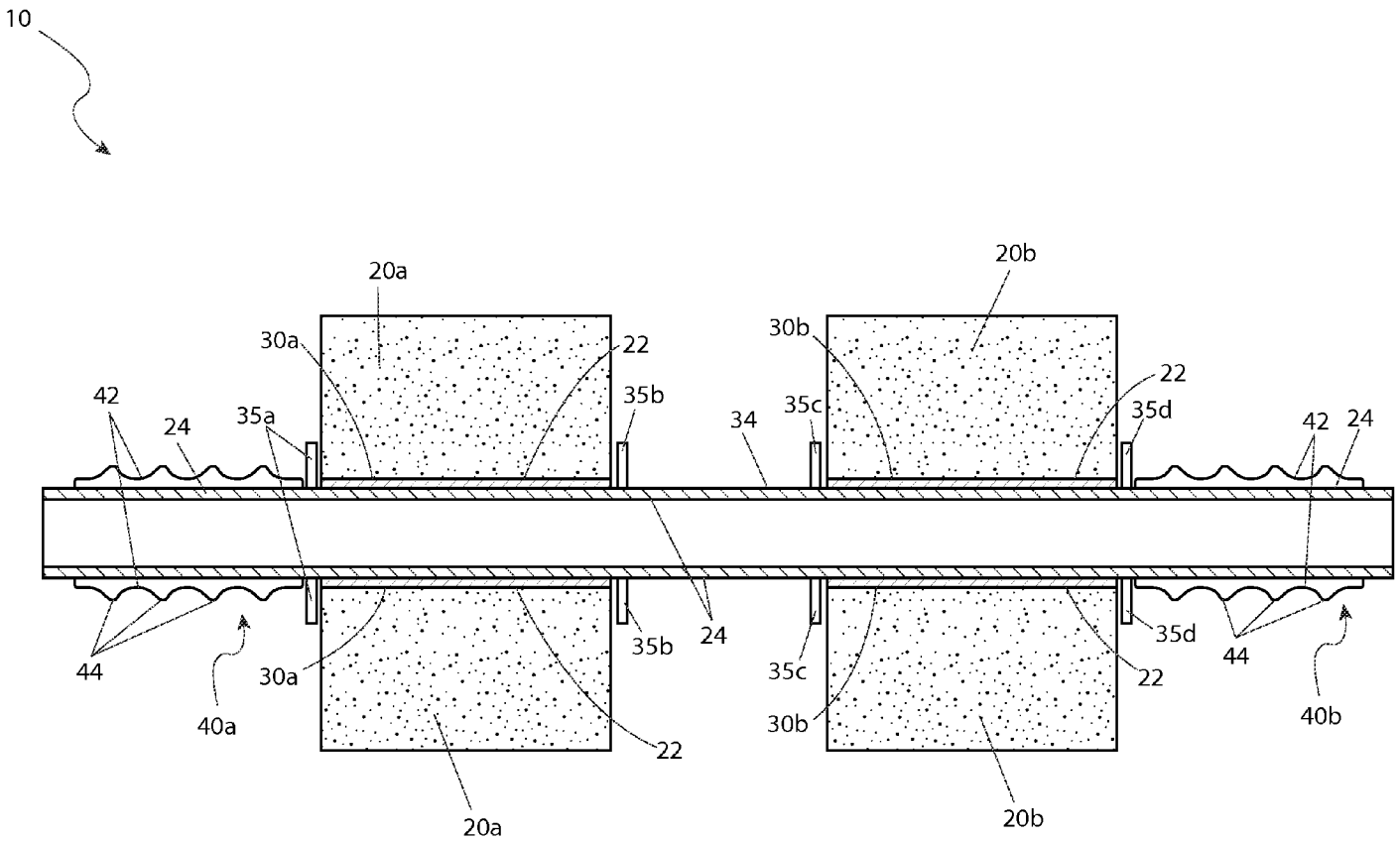

The best mode for carrying out the invention is presented in terms of its preferred embodiment, herein is depicted in FIGS. 1 through 3. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes an abdominal exercise device (herein described as the "device") 10, which provides an exercise aid designed to work and strengthen abdominal muscles 105 while a user 100 is in a standing position.

Referring now to FIG. 1, a perspective view of the device 10, according to a preferred embodiment of the present invention, is disclosed. The device 10 is approximately twenty-eight inches (28 in.) in length and four inches (4 in.) in diameter, further comprising a central tube 24 forming an axle means with first handle 40*a* and second handle 40*b* end portions. A first roller 20*a* and a second roller 20*b* are rotatingly affixed to the tube 24 via respective internal freely-rotating first bushing 30*a* and second bushing 30*b* portions. The rollers 20*a*, 20*b* provide padding to protect a user's legs during exercising. The tube 24 further comprises a pair of grips 42 mounted to end portions (see FIG. 3).

Referring now to FIGS. 2*a* and 2*b*, environmental views of the device 10 depicting erect and forwardly extended positions, according to a preferred embodiment of the present invention, are disclosed. The device 10 is utilized to develop abdominal muscles 105 by beginning an exercise from a standing position, grasping the handles 40*a*, 40*b* with both hands 110, and pressing the rollers 20*a*, 20*b* against a hip area just above the user's 100 pubic bone. The rollers 20*a*, 20*b* are then rolled over respective left and right quadriceps 115 toward the user's knee portions while maintaining pressure against the user's quadriceps. By repeating the exercise motion of the device 10, the abdominal muscles 105 are tightened and curled in a repetitive and reciprocating manner while in the standing position.

Referring now to FIG. 3, a sectional view of the device 10 taken along section line A-A (see FIG. 1), according to a preferred embodiment of the present invention, is disclosed. The device 10 comprises a central tube 24 preferably made of a metal material such as stainless steel or aluminum. The tube 24 forms the main axle of the device 10 and extends outwardly forming first handle 40*a* and second handle 40*b* end portions which provide respective laterally-adjustable grips 42 for a user's 100 left and right hands 110 during exercising. A center portion of the tube 24 is encompassed around by a pair of freely rotating tubular bushings 30*a*, 30*b* made of TEFLON®, nylon, or other material having equivalent lubricity characteristics. The bushings 30*a*, 30*b* comprise respective first roller section 20*a* and second roller section 20*b* portions, each comprising an outer diameter being sized so as to be snuggly inserted into the first 20*a* and second 20*b* rollers. The rollers 20*a*, 20*b* comprise cylindrical shapes having center aperture portions 22 into which the bushings 30*a*, 30*b* are inserted. The rollers 20*a*, 20*b* are preferably made of a padding material such as urethane foam rubber or equivalent soft compliant material. The bushings 30*a*, 30*b* provides a means to separate and position the rollers 20*a*, 20*b* laterally along the tube 24 via a plurality of perpendicularly-extending disc-shaped members including a first collar 35*a*, a second collar 35*b*, a third collar 35*c*, and a fourth collar 35*d*. The first collar 35*a* and second collar 35*b* are positioned against opposing side surfaces of the first roller 20*a*, and the third collar 35*c* and fourth collar 35*d* are positioned against opposing side surfaces of the second roller 20*b*. The collars 35*a*, 35*b*, 35*c*, 35*d* preferably comprise a radial slit 36 which allows expansion of a center opening portion of each collar 35*a*, 35*b*, 35*c*, 35*d*, thereby allowing sliding positioning along the tube 24; however, it is understood that each collar 35*a*, 35*b*, 35*c*, 35*d* may also comprise a continuous disc which utilizes an interference fit around the tube 24 having equal benefit, and as such should not be interpreted as a limiting factor of the device 10. The rollers 20*a*, 20*b* are preferably positioned approximately six inches (6 in.) from each other using the collars 35*a*, 35*b*, 35*c*, 35*d* to form a recessed intermediate section 34, thereby allowing the device 10 to be rolled comfortably without contacting the user's 100 groin area.

The grips 42 are securely inserted upon each handle portion 40*a*, 40*b* via a tight friction-fit allowing lateral adjustment along the handles 40*a*, 40*b* based upon a user's preference. Each grip 42 comprises a plastic or rubber tubular form similar to a bicycle handlebar grip. The grips 42 are envisioned to provide a user 100 a plurality of molded-in finger relief features 44 for a firm hold.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple manner with little or no training. After initial purchase or acquisition of the device 10, it would be utilized as indicated in FIGS. 2*a* and 2*b*.

The method of utilizing the device 10 may be achieved by performing the following steps: procuring the device 10; adjusting a position of each grip 42 and each roller 20*a*, 20*b* laterally upon the tube 24 based upon a user's preference; grasping the handles 40*a*, 40*b* with both hands 110 while in a standing position; pressing the rollers 20*a*, 20*b* against a hip area just above the pubic bone; leaning slightly forward while vertically motioning the rollers 20*a*, 20*b* downwardly over respective left and right quadriceps 115 toward a knee area while maintaining pressure against the quadriceps; reversing movement of the rollers 20*a*, 20*b* in an upward direction to the hip area again in a reciprocating manner; repeating the up-and-down exercise motioning of the device 10 for a desired number of repetitions; and, benefiting from an effective abdominal workout while occupying a standing position afforded user of the present invention 10.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. An exercise device comprising:

a central tubular member defining a central axis;

a first handle and a second handle, each of said handles being formed at opposite ends of said central tubular member;

a first roller coaxially mounted on said central tubular member so as to rotate freely about said central tubular member;

a second roller coaxially mounted on said central tubular member so as to rotate freely about said central tubular member, wherein said first and said second rollers are longitudinally spaced apart from one another to form a recessed intermediate section there between; and four perpendicularly-extending disc-shaped collars mounted on said central tubular member via central opening portions, each of which includes a radial slit which allows expansion of its center opening portion, two of said disc-shaped collars being on opposing sides of said first roller and two of said disc-shaped collars being on opposing sides of said second roller;

wherein each radial slit allows its respective disc-shaped collar to be selectively positioned along said central tubular member.

2. The device as set forth in claim 1 wherein said first handle and said second handle each further comprise a molded gripping area.

3. The device as set forth in claim 1 wherein said first handle and said second handle each are longitudinally movable on said central tubular member.

4. The device as set forth in claim 1 wherein said first roller and said second roller are each formed as cylindrical shapes with said first roller having a first roller center aperture portion and said second roller having a second roller center aperture portion.

5. The device as set forth in claim 4 wherein said first roller further comprises a first bushing inserted into said first roller center aperture portion, and said second roller further comprises a second bushing inserted into said second roller center aperture portion.

6. The device as set forth in claim 5 wherein said first and said second bushings are constructed from TEFLON®.

7. The device as set forth in claim 1 wherein said first and second rollers are formed of dense foam material.

8. The device as set forth in claim 1 wherein said central tubular member is constructed of aluminum.

9. An exercise device comprising:

a central tubular member defining a central axis;

a first handle and a second handle, each mounted at opposite ends of said central tubular member, being longitudinally movable and each further including a molded gripping area;

a first roller including a center aperture portion and a first bushing inserted therein being coaxially mounted on said central tubular member;

a second roller including a center aperture portion and a second bushing inserted therein being coaxially mounted on said central tubular member, wherein said first and said second rollers are longitudinally spaced apart from one another so as to form a recessed intermediate section; and four perpendicularly-extending disc-shaped collars mounted on said central tubular member via central opening portions, each of which includes a radial slit which allows expansion of its center opening portion, two of said disc-shaped collars being on opposing sides of said first roller and two of said disc-shaped collars being on opposing sides of said second roller;

wherein each radial slit allows its respective disc-shaped collar to be selectively positioned along said central tubular member.

10. The device as set forth in claim 9 wherein said first roller and said second roller are each formed as cylindrical shapes.

11. The device as set forth in claim 9 wherein said first and said second bushings are constructed from nylon.

12. The device as set forth in claim 9 wherein said first and second rollers are formed of dense foam material.

13. The device as set forth in claim 9 wherein said central tubular member is constructed of stainless steel.

14. An exercise device comprising: a central tubular member defining a central axis and constructed of a rigid material;

a first handle and a second handle, each mounted at opposite ends of said central tubular member, being longitudinally movable and each further including a molded gripping area;

a first roller including a center aperture portion and a first bushing inserted therein being coaxially mounted on said central tubular member;

a second roller including a center aperture portion and a second bushing inserted therein being coaxially mounted on said central tubular member, said first and said second rollers being longitudinally spaced apart from one another on said central tubular member so as to form a recessed intermediate section there between;

a first and second disc-shaped collar each having a radial slit and each being coaxially mounted on said central tubular member against opposing side surfaces of said first roller so that they are operatively adapted to slidingly locate and retain longitudinal position of said first roller on said central tubular member; and, a third and fourth disc-shaped collar each having a radial slit and each being coaxially mounted on said central tubular member against opposing side surfaces of said second roller so that they are operatively adapted to slidingly locate and retain longitudinal position of said second roller on said central tubular member.

* * * * *